US010317083B2

(12) United States Patent
Wang et al.

(10) Patent No.: US 10,317,083 B2
(45) Date of Patent: Jun. 11, 2019

(54) FUEL NOZZLE

(71) Applicant: PRATT & WHITNEY CANADA CORP., Longueuil (CA)

(72) Inventors: Yen-Wen Wang, Mississauga (CA); Nigel Davenport, Hillsburgh (CA); Eduardo Hawie, Woodbridge (CA)

(73) Assignee: PRATT & WHITNEY CANADA CORP., Longueuil (CA)

( * ) Notice: Subject to any disclaimer, the term of this patent is extended or adjusted under 35 U.S.C. 154(b) by 818 days.

(21) Appl. No.: 14/505,778

(22) Filed: Oct. 3, 2014

(65) Prior Publication Data

US 2016/0097537 A1 Apr. 7, 2016

(51) Int. Cl.

| | |
|---|---|
| ***F23R 3/04*** | (2006.01) |
| ***F23R 3/28*** | (2006.01) |
| ***F23R 3/12*** | (2006.01) |
| ***F23R 3/30*** | (2006.01) |
| ***F23R 3/10*** | (2006.01) |
| ***F23D 14/20*** | (2006.01) |

(52) U.S. Cl.

CPC ..... *F23R 3/286* (2013.01); *F23D 14/20* (2013.01); *F23R 3/04* (2013.01); *F23R 3/10* (2013.01); *F23R 3/12* (2013.01); *F23R 3/30* (2013.01); *F23D 2206/10* (2013.01); *F23D 2900/11101* (2013.01)

(58) Field of Classification Search

CPC .... F23R 3/04; F23R 3/004; F23R 3/14; F23R 3/12; F23R 3/28; F23R 3/286; F23R 3/30; F23C 7/002; F23C 7/004; F23D 11/107; F23D 2900/11101; F23D 11/105; F23D 11/106

See application file for complete search history.

(56) References Cited

U.S. PATENT DOCUMENTS

| | | | | |
|---|---|---|---|---|
| 2,768,497 | A * | 10/1956 | Hayes | F23R 3/14 60/748 |
| 3,866,413 | A * | 2/1975 | Sturgess | F23R 3/36 239/400 |
| 3,912,164 | A * | 10/1975 | Lefebvre | F23D 11/12 239/400 |
| 4,982,570 | A * | 1/1991 | Waslo | F23D 11/005 60/733 |
| 5,813,847 | A | 9/1998 | Eroglu et al. | |
| 6,276,141 | B1 | 8/2001 | Pelletier | |
| 6,289,676 | B1 | 9/2001 | Prociw et al. | |
| 6,289,677 | B1 | 9/2001 | Prociw et al. | |
| 6,889,495 | B2 * | 5/2005 | Hayashi | F23D 14/70 60/39.37 |
| 7,266,945 | B2 * | 9/2007 | Sanders | F23D 11/101 60/743 |
| 7,454,914 | B2 | 11/2008 | Prociw | |

(Continued)

*Primary Examiner* — Steven M Sutherland
*Assistant Examiner* — Thuyhang N Nguyen
(74) *Attorney, Agent, or Firm* — Norton Rose Fulbright Canada LLP

(57) ABSTRACT

A fuel nozzle for a combustor of a gas turbine engine includes a body defining an axial direction and a radial direction, an air passageway defined axially in the body, and a fuel passageway defined axially in the body radially outwardly from the air passageway. The fuel passageway has an outer wall including an exit lip at a downstream portion of the outer wall. The lip generally increases in diameter as it extends downstream.

13 Claims, 5 Drawing Sheets

(56) References Cited

U.S. PATENT DOCUMENTS

| | | | | |
|---|---|---|---|---|
| 7,766,251 | B2 | 8/2010 | Mao et al. | |
| 7,878,000 | B2 * | 2/2011 | Mancini | F23R 3/14 60/737 |
| 8,096,135 | B2 | 1/2012 | Caples | |
| 9,791,149 | B2 * | 10/2017 | Inoue | F23D 14/70 |
| 2005/0097889 | A1 * | 5/2005 | Pilatis | F23D 11/107 60/743 |
| 2006/0021350 | A1 * | 2/2006 | Sanders | F23D 11/101 60/743 |
| 2013/0067920 | A1 * | 3/2013 | Fox | F23R 3/14 60/738 |
| 2014/0090382 | A1 | 4/2014 | Sandelis et al. | |
| 2014/0090394 | A1 | 4/2014 | Low et al. | |

* cited by examiner

FUEL NOZZLE

TECHNICAL FIELD

The application relates generally to gas turbines engines combustors and, more particularly, to fuel nozzles.

BACKGROUND

Gas turbine engine combustors employ a plurality of fuel nozzles to spray fuel into the combustion chamber of the gas turbine engine. The fuel nozzles atomize the fuel and mix it with the air to be combusted in the combustion chamber. The atomization of the fuel and air into finely dispersed particles occurs because the air and fuel are supplied to the nozzle under relatively high pressures. The fuel could be supplied with high pressure for pressure atomizer style or low pressure for air blast style nozzles providing a fine outputted mixture of the air and fuel may help to ensure a more efficient combustion of the mixture. Finer atomization provides better mixing and combustion results, and thus room for improvement exists.

SUMMARY

In one aspect, there is provided a fuel nozzle for a combustor of a gas turbine engine, the fuel nozzle comprising: a body defining an axial direction and a radial direction; an air passageway defined axially in the body; a fuel passageway defined axially in the body radially outwardly from the air passageway, the fuel passageway having an outer wall including an exit lip at a downstream portion of the outer wall, the lip generally increasing in diameter as it extends downstream.

In another aspect, there is provided a gas turbine engine comprising: a combustor; and a plurality of fuel nozzles disposed inside the combustor, each of the fuel nozzles including: a body defining an axial direction and a radial direction; an air passageway defined axially in the body; a fuel passageway defined axially in the body radially outwardly from the air passageway, the fuel passageway having an outer wall including an exit lip at a downstream portion thereof the lip generally increasing in diameter as it extends downstream.

In a further aspect, there is provided a method of delivering fuel from a fuel nozzle of a gas turbine engine, the method comprising: carrying by a fuel passageway of the fuel nozzle a film of pressurised fuel, the fuel passageway being disposed radially outwardly from an air passageway carrying a flow of pressurised air; and directing the film of pressurised fuel onto an inside surface of an exit lip of an outer wall of the fuel passageway and thinning the film of pressurised fuel as it travels therealong, the exit lip generally increasing in diameter as it extends downstream.

BRIEF DESCRIPTION OF THE DRAWINGS

Reference is now made to the accompanying figures in which.

DETAILED DESCRIPTION

Figure 1:
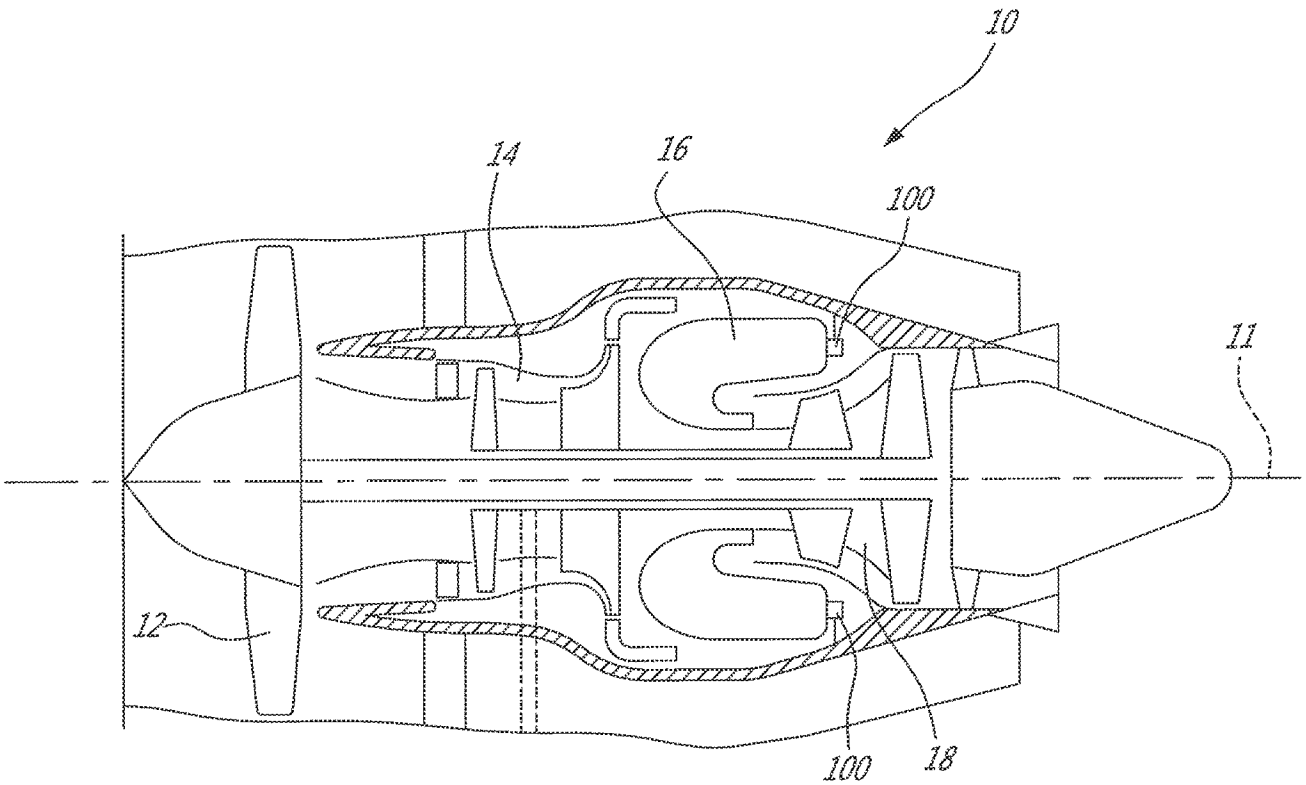
FIG. 1 is a schematic cross-sectional view of a gas turbine engine.

FIG. 1 illustrates a gas turbine engine 10 of a type preferably provided for use in subsonic flight, generally comprising in serial flow communication a fan 12 through which ambient air is propelled, a compressor section 14 for pressurizing the air, a combustor 16 in which the compressed air is mixed with fuel and ignited for generating an annular stream of hot combustion gases, and a turbine section 18 for extracting energy from the combustion gases. The gas turbine engine 10 has one or more fuel nozzles 100 which supply the combustor 16 with the fuel which is combusted with the air in order to generate the hot combustion gases. The fuel nozzle 100 atomizes the fuel and mixes it with the air to be combusted in the combustor 16. The atomization of the fuel and air into finely dispersed particles occurs because the air and fuel are supplied to the nozzle 100 under relatively high pressures. The fuel could be supplied with high pressure for pressure atomizer style or low pressure for air blast style nozzles providing a fine outputted mixture of the air and fuel, which may help to ensure a more efficient combustion of the mixture. The nozzle 100 is generally made from a suitably heat resistant metal or alloy because of its position within, or in proximity to, the combustor 16.

Figure 2:
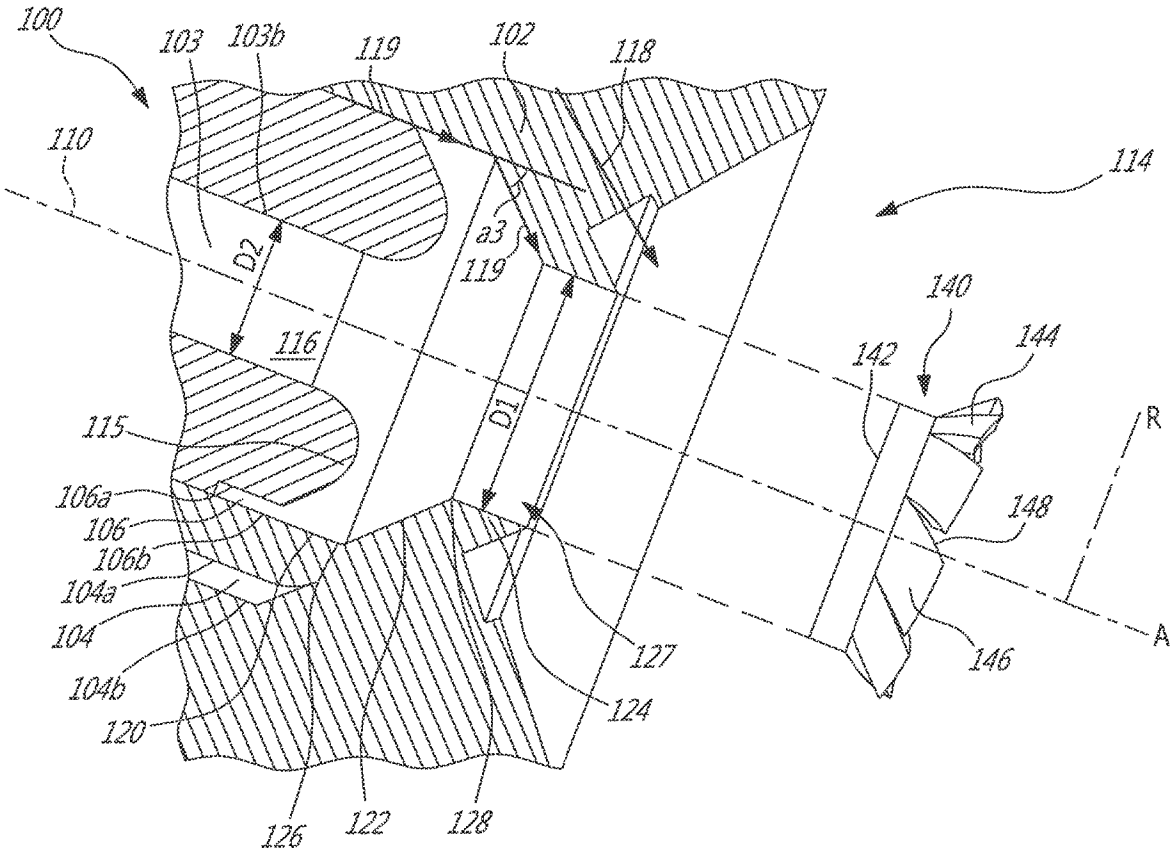
FIG. 2 is a partial schematic cross-sectional view of an embodiment of a nozzle for a combustor of the gas turbine engine of FIG. 1 including a lip extender.

Turning now to FIG. 2, an embodiment of a fuel nozzle 100 will be described.

The nozzle 100 includes generally a cylindrical body 102 defining an axial direction A and a radial direction R. The body 102 is at least partially hollow and defines in its interior a primary air passageway 103 (a.k.a. core air), a secondary air passageway 104 and a fuel passageway 106, all extending axially through the body 102.

The primary air passageway 103, the secondary air passage 104 and the fuel passageway 106 are aligned with a central axis 110 of the nozzle 100. The fuel passageway 106 is disposed concentrically between the primary air passageway 103 and the secondary air passageway 104. The secondary air passageway 104 and the fuel passageway 106 are annular. It is contemplated that the nozzle 100 could include more than one primary and secondary air passageways 103, 104 and that the primary and secondary air passageways 103, 104 could have a shape of any one of a conduit, channel and an opening. The size, shape, and number of the air passageways 103, 104 may vary depending on the flow requirements of the nozzle 100, among other factors. Similarly, although one annular fuel passage 106 is disclosed herein, it is contemplated that the nozzle 100 could include a plurality of fuel passageways 106, annular shaped or not.

The body 102 includes an upstream portion (not shown) connected to sources of pressurised fuel and air and a downstream portion 114 at which the air and fuel exit. The terms "upstream" and "downstream" refer to the direction along which fuel flows through the body 102. Therefore, the upstream end of the body 102 corresponds to the portion where fuel/air enters the body 102, and the downstream portion 114 corresponds to the portion of the body 102 where fuel/air exits.

The primary air passageway 103 is defined by outer wall 103*b*. The outer wall 103*b* ends at exit end 115. The primary air passageway 104 carries pressurised air illustrated by arrow 116. The air 116 will be referred interchangeably herein to as "air", "jet of air", "stream of air" or "flow of air".

The secondary air passageway 104 is defined by inner wall 104*a* and outer wall 104*b*. The secondary air passageway 104 carries pressurised air illustrated by arrow 118. The air 118 will be referred interchangeably herein to as "air", "film of air", "jet of air", "stream of air" or "flow of air".

The fuel passageway 106 is defined by inner wall 106*a* and outer wall 106*b*. The fuel passageway 106 carries pressurised fuel illustrated by arrow 119. The fuel 119 will be referred interchangeably herein to as "fuel film" or "fuel".

The secondary air passageway 104 and the fuel passageway 106 are typically convergent (i.e. cross-sectional area may decrease along its length, from inlet to outlet) in the downstream direction at the downstream portion 114.

The outer wall 106*b* of the fuel passage 106 includes a first straight portion 120, a second converging portion 122 extending from a downstream end 126 of the straight portion 120, and a third straight portion 124 extending from a downstream end 128 of the converging portion 122. The third straight portion 124 forms an exit lip 127 of the nozzle 100. The exit lip 127 is disposed downstream relative to the exit end 115 of the primary air passageway 103. A diameter D1 of the outer wall 106*b* at the third straight portion 124 is slightly bigger than a diameter D2 of the outer wall 103*b* of the primary air passageway 103.

The outer wall 106*b* of the fuel passageway 106 is converging at the downstream portion 114, thereby forcing the annular fuel film 119 expelled by the fuel passageway 106 onto the jet of air 116 expelled from the primary air passageway 103. Similarly, the outer wall 104*b* of the secondary air passageway 104 are converging at the downstream portion 114, thereby forcing the annular film of air 118 expelled by the secondary air passageway 104 onto the annular fuel film 119. At the downstream portion 114, the annular fuel film 119 is sandwiched by the jet of air 116 of the primary air passageway 103 and the annular flow of air 118 of the secondary air passageway 104.

The nozzle 100 further includes an annular lip extender 140 fitted in the exit lip 127 of the nozzle 100 and extending downstream outwardly therefrom. The lip extender 140 may be fitted to pre-existing nozzles 10. The lip extender 140 could also be integrally formed with the exit lip 127. The lip extender 140 is disposed radially between the air 116 from the primary air passageway 103 and the air 118 coming from the secondary air passageway 104. In one embodiment, the lip extender 140 includes a ring 142 sized to fit tightly with the outer walls 106*b*, and a flared portion 144 extending from the ring 142. The flared portion 144 comprises, in this embodiment, a plurality of tabs 146 connected to each other at the ring 142. A plurality of wedge shaped gaps 148 is defined between the tabs 146. The gaps 148, in this embodiments are wider at a downstream end relative to an upstream end. The gaps 148 create a channel communication between an inside and an outside of the lip extender 140, which in turn favors shearing of the fuel film 119, as will be described below.

Figure 3:
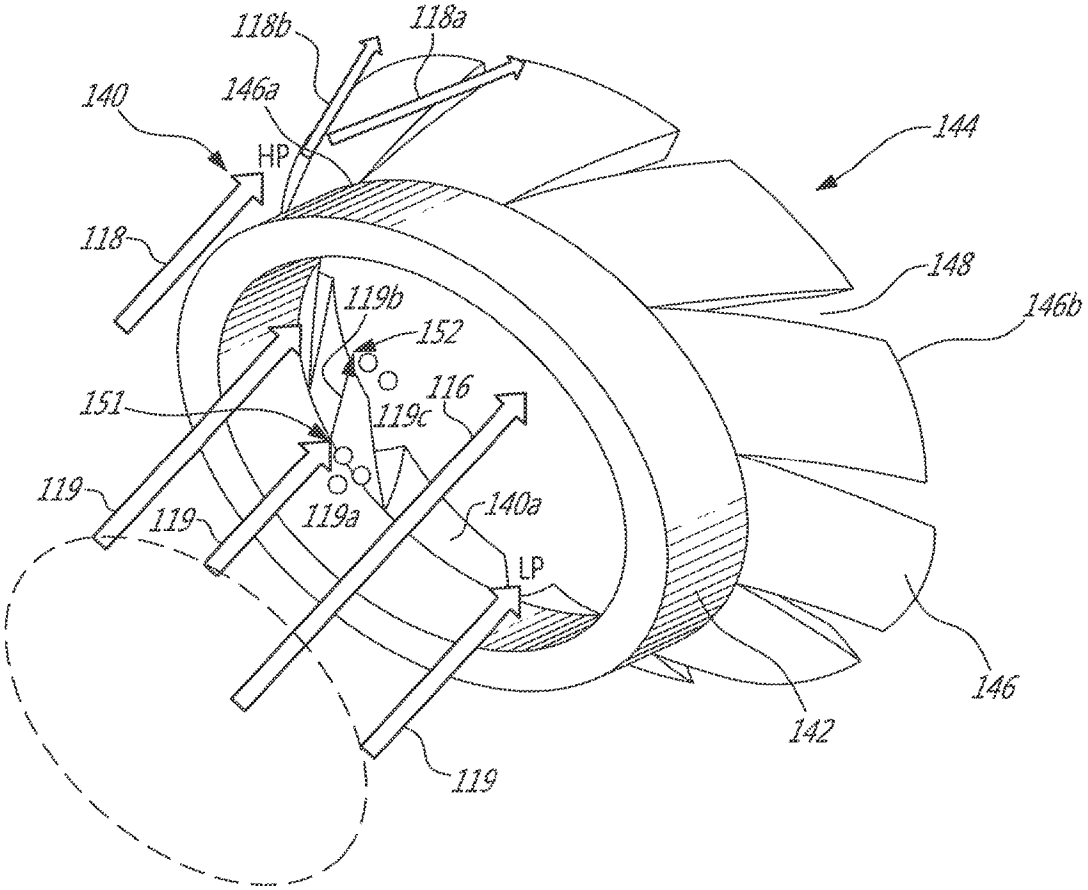
FIG. 3 is a schematic perspective view of the lip extender of FIG. 2.
Figure 4:
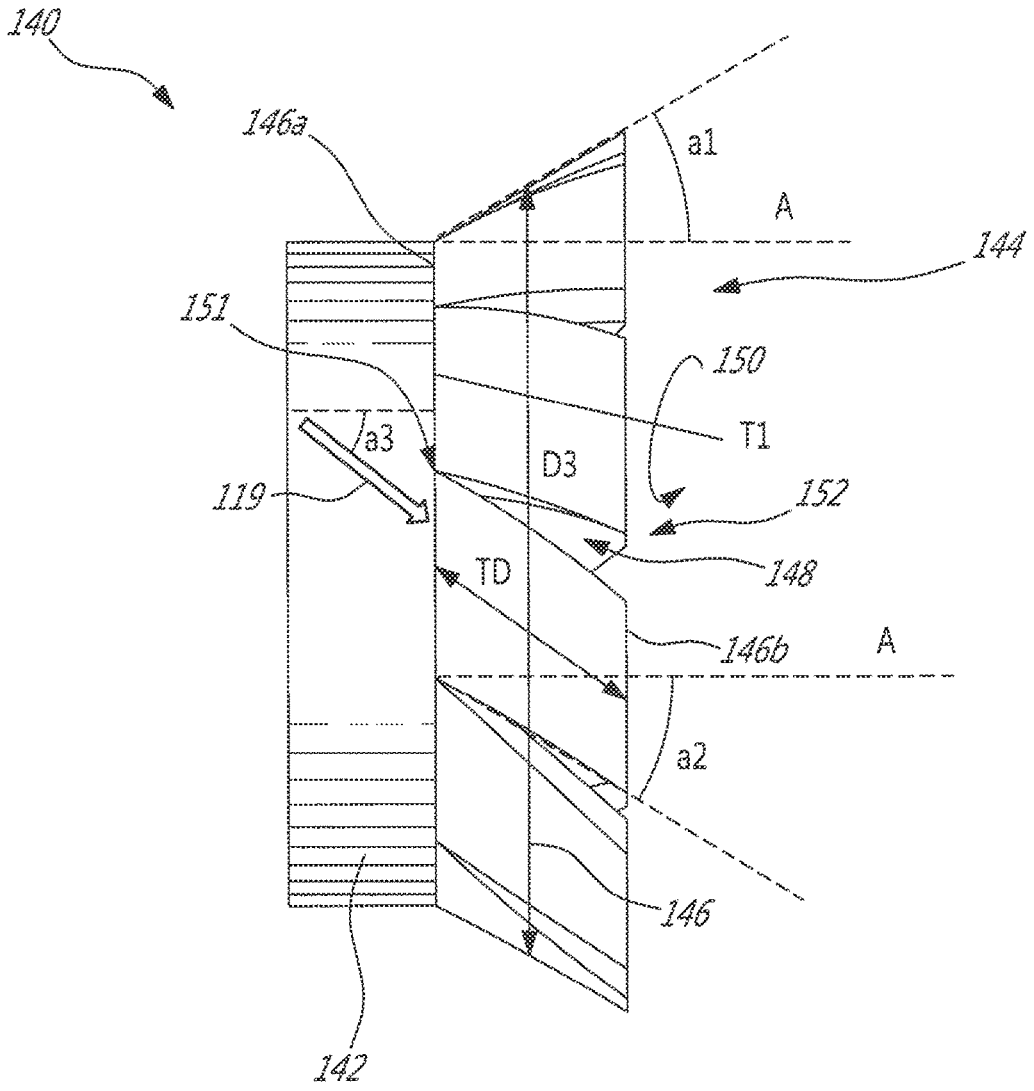
FIG. 4 is a schematic side elevation view of the lip extender of FIG. 2.
Figure 5:
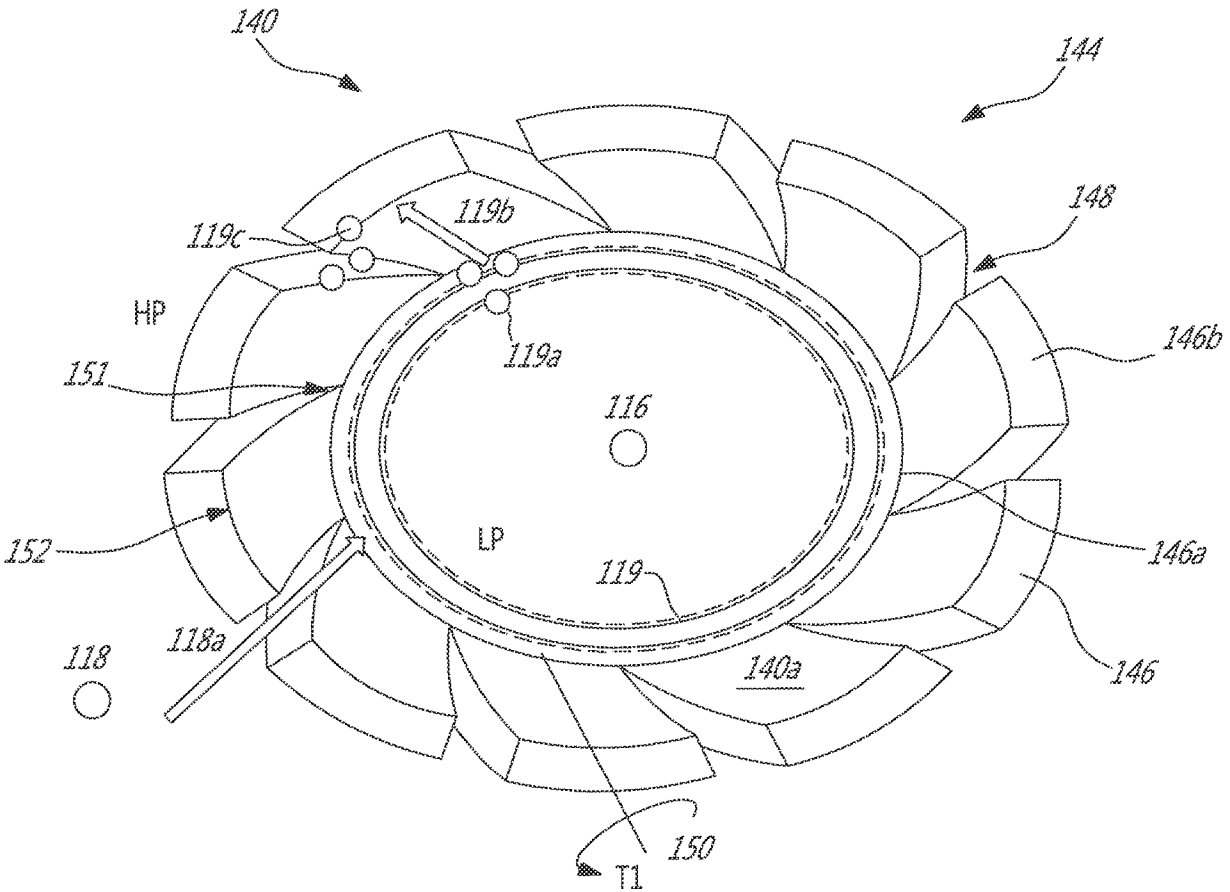
FIG. 5 is a schematic front view of the lip extender of FIG. 2.

Turning now to FIGS. 3 to 5, the tabs 146 extend both downstream and radially outward in a length-wise axis T1 at an angle a1 with the axial axis A. The tabs 146 flare so that the fuel film 119 traveling onto an inside surface 104*a* of the flared portion 144, stretches outwardly and thins, due to the increase of diameter D3 of the flared portion 144. The stretched fuel film 119 in turn allows increasing shear between the air 118, 116 and the fuel 119, and providing more than one fuel breakup location. The flaring angle a1 may be selected to be less than an angle at which the fuel film 119 would detach from the inside surface 104*a* to ensure stretching of the fuel film 119.

The tabs 146 may also be inclined and/or twisted, to favor the thinning of the fuel film 119. The tabs 146 may be circumferentially inclined (i.e. tilted) at an angle a2 relative to the axial axis A, which may be selected to correspond to a fuel ejection angle a3 (shown in FIG. 3) of the fuel 119 exiting the fuel passageway 106. The fuel ejection angle a3 is due to an inclination of the second portion 122 relative to the first portion 120 of outer wall 106*b* of the fuel passage 106. The tabs 146 may also be slightly twisted about the length-wise axis T1 of each tab 146, in order to better match a swirl angle of the fuel 119. A twist of the tabs 146 is illustrated by arrow 150. Whether the fuel passageway 106 includes fuel swirlers or not, the fuel 119 may have a residual swirl and hence, exit the fuel passageway 106 at an inherent swirl angle. The tabs 146 may be positioned at various angles relative to the fuel 119, however matching at least one of the angle a2 and the twist angle of the tabs 146 with the fuel ejection angle a3 or the inherent swirl angle of the fuel 119 may increase a travel distance TD of the residual fuel 119*b* along the tabs 146. The travel distance TD may be related to a thinning of the fuel film 119. A larger distance TD may thus result in a thinner fuel film 119.

The flared portion 144 could have various shapes, including or not the tabs 146 and gaps 148 described above. For example, the gaps 148 could be omitted and the flared portion 144 could be conical shaped. In another example, the gaps 148 could be replaced by openings in an otherwise continuous flared portion 144.

The lip extender 140 creates two fuel breakdown locations, 151, 152. The first breakdown location 151 occurs at an upstream end 146*a* of the tabs 146. This location is a similar location as if the lip extender 140 would be omitted. At the first break down location 151, the sharp turn that the fuel film 119 has to make in order to continue to flow from the ring 142 against the tabs 146 creates a separation from a first portion 119*a* of the fuel film from a rest (illustrated by skinnier arrow 119*b*) of the fuel film 119 and as a result the formation of a first plurality of droplets (illustrated schematically by small circles).

The second breakdown location 152 occurs at a downstream end 146*b* of the tabs 146. At the second breakdown location 152, the absence of material causes a sharp turn to the fuel film 119*b*, which creates the formation of a second plurality of droplets 119*c* (illustrated schematically by small circles).

The flared portion 144 flares to stretch the fuel film 119 exiting the fuel passageway 106. The fuel film 119 flowing on the inside of the flared portion 144 may see its diameter increasing with the flaring of the flared portion 144 and as a result may stretch and thin out. When reaching a downstream end 146*b* of the tabs 146, the fuel film 119 may be at its thinnest, thus easier to break down into the droplets 119*c*.

The gaps 148 between the tabs 146 create a channel communication between a zone of high pressure HP and a zone of low pressure LP, created by the presence of the flaring portion 144. The difference in pressure forces a portion 118*a* of the air 118 exiting the secondary air passageway 104 into the inside of the flaring portion 144 via the gaps 148 to the contact of the fuel film 119, while a remaining portion 118*b* of the air stays outside the flaring portion 144 and contact the fuel 119*b* at the second breakup location 152. The fuel film 119*b*, which has already be thinned by the travel along the tabs 146 may become sheared between the air streams 118*b* and 116. It is contemplated, however that the gaps 148 could be omitted and that the tabs 146 could be replaced by a truncated cone. The gaps 148 could have various shapes. For example, the gaps 148 could be slots, or just openings.

Since the nozzle 100 is extended into the combustor 16 by the lip extender 140, fuel/soot might build up along the inside surface 140*b* if there is any stagnation region. By creating gaps 148, high speed jets of air 118*a* may help to "wash" away those fuel/soot build-up, and hence, decrease the likelihood of carbon build-up.

The fuel nozzle 100 functions as follows. The fuel film 119 is carried by pressure difference into the fuel passageway 106 until the exit lip 127. Because of a tangential component of the velocity of the fuel film 119 and of the presence of the pressurised flow of air 116, the fuel film 119 tends to flow against the outer wall 106*b* of the fuel passageway 106. When the pressurised fuel 119 reaches the exit lip 127, it is redirected partially onto the inside surface 140*a* of the lip extender 140. The sharp turn between the ring 142 and the orientations of the tabs 146 creates a shear with the air 116 and the creating of droplets 119*a* of fuel at the first break up location 151. The remaining tangential component of the velocity and the pressurised flow of air 116 ensure that the remaining portion of the fuel 119*b* travels along the inside surface 140*a* of the tabs 146. Because the quantity of fuel 119*b* is lesser than the quantity of fuel 119 before break up, the fuel film 119*b* is thinner than the fuel film 119. In addition, because the lip extender 140 flares outwardly, a diameter of the fuel film 119*b* expands, and as a result a thickness of the fuel film 119*b* decreases. When the fuel film 119*b* reaches the downstream end 146*b* of the tabs 146, the shearing with the air 118 and 116 induces a second breakdown into droplets at the breakdown location 152. In addition, as the fuel film 119*b* travels and thins along the inside surface 140*a*, the portion 118*a* of the air 118 enters the inside the lip extender 140 and creates more shearing and interaction with the fuel film 119*b* for an enhance atomisation.

The above description is meant to be exemplary only, and one skilled in the art will recognize that changes may be made to the embodiments described without departing from the scope of the invention disclosed. Other modifications which fall within the scope of the present invention will be apparent to those skilled in the art, in light of a review of this disclosure, and such modifications are intended to fall within the appended claims.

The invention claimed is:

1. A fuel nozzle for a combustor of a gas turbine engine, the fuel nozzle comprising:
   - a body defining an axial direction and a radial direction;
   - a primary air passageway extending through the body, a central axis extending centrally through the primary air passageway in the axial direction;
   - a fuel passageway extending axially through the body in the axial direction, the fuel passageway located radially outwardly from the primary air passageway, and the fuel passageway having an outer wall forming an exit lip located at a downstream end of the outer wall and projecting downstream from the downstream end;
   - a secondary air passageway disposed radially outwardly from the primary fuel passageway; and
   - the exit lip of the body of the fuel nozzle having a flared portion extending radially outwardly from the downstream end of the outer wall, the flared portion of the exit lip disposed radially between the primary air passageway and the secondary air passageway, the flared portion increasing in diameter as the flared portion extends downstream, the flared portion of the exit lip including a plurality of tabs that are circumferentially arranged, each of the tabs having an inside surface facing radially inwardly and adapted to receive a fuel film thereon, the inside surfaces of the tabs forming an annular fuel flow surface circumferentially interrupted by a plurality of circumferentially arranged gaps disposed between the tabs, the circumferentially arranged gaps forming radial airflow channels fluidly connecting the primary air passageway and the secondary air passageway, each of the tabs extending in a tab direction along a tab length-wise axis, the tabs being radially outwardly inclined to define a flaring angle extending radially outwardly and being circumferentially inclined at a circumferential angle relative to the central axis.

2. The fuel nozzle of claim 1, wherein the tab length-wise axis in the tab direction forming the flaring angle with central axis in the axial direction, the flaring angle being less than an angle at which the fuel film on the inside surfaces of the tabs will detach.

3. The fuel nozzle of claim 1, wherein the circumferentially arranged gaps are wedge shaped, the circumferentially arranged gaps extending from a point between circumferentially adjacent tabs at an upstream end of the circumferentially arranged gaps to a circumferential opening between the circumferentially adjacent tabs at a downstream end the circumferentially arranged gaps, the downstream end of the circumferentially arranged gaps being circumferentially narrower than a circumferential width of a downstream end of each of the tabs.

4. The fuel nozzle of claim 1, wherein said circumferential angle relative to the central axis at which the tabs are circumferentially inclined corresponds to a fuel ejection angle of the fuel exiting the fuel passageway.

5. The fuel nozzle of claim 1, wherein each of the plurality of tabs is twisted about the tab length-wise axis in the tab direction.

6. The fuel nozzle of claim 1, wherein each of the tabs has an upstream end and a downstream end, a circumferential width of the downstream end being substantially equal to that of the upstream end.

7. The fuel nozzle of claim 6, wherein the tabs are substantially rectangular in shape.

8. A gas turbine engine comprising:
   - a combustor; and
   - a plurality of fuel nozzles disposed inside the combustor, each of the fuel nozzles including:
     - a body defining an axial direction and a radial direction;
     - a primary air passageway extending through the body, a central axis extending centrally through the primary air passageway in the axial direction;
     - a fuel passageway defined axially in the body radially outwardly from the primary air passageway;
     - a secondary air passageway disposed radially outwardly from the fuel passageway;
     - an exit lip at a downstream portion of an outer wall of the fuel passageway, the exit lip increasing in diameter as the exit lip extends downstream, the exit lip including circumferentially arranged tabs extending radially outwardly from the outer wall to define a radially outwardly extending flaring angle, the circumferentially arranged tabs being radially disposed between the primary air passageway and the secondary air passageway, each of the circumferentially arranged tabs extending in a tab direction along a tab length-wise axis, the tabs being circumferentially inclined at a circumferential angle relative to the central axis, and each of the circumferentially arranged tabs having an inside surface facing radially inwardly and adapted to receive a fuel film thereon, the circumferentially arranged tabs being spaced from each other by a plurality of circumferentially arranged gaps providing radial airflow through the circumferentially arranged tabs to shear the fuel film on the inside surfaces of the circumferentially arranged tabs; and the circumferentially arranged gaps forming radial airflow channels fluidly connecting the primary air passageway and the secondary air passageway.

9. The gas turbine engine of claim 8, wherein the circumferentially arranged gaps are wedge shaped, the circumferentially arranged gaps extending from a point between circumferentially adjacent tabs at an upstream end of the circumferentially arranged gaps to a circumferential opening between the circumferentially adjacent tabs at a downstream end of the circumferentially arranged gaps, the downstream end of the circumferentially arranged gaps being circumferentially narrower than a circumferential width of a downstream end of each of the tabs.

10. The gas turbine engine of claim 8, wherein said circumferential angle relative to the central axis at which the tabs are circumferentially inclined corresponds to a fuel ejection angle of the fuel exiting the fuel passageway.

11. The gas turbine engine of claim 8, wherein each of the circumferentially arranged tabs is twisted about the tab length-wise direction in the tab direction.

12. The gas turbine engine of claim 8, wherein each of the tabs of the fuel nozzles has an upstream end and a downstream end, a circumferential width of the downstream end being substantially equal to that of the upstream end.

13. The gas turbine engine of claim 12, wherein the tabs are substantially rectangular in shape.

* * * * *